United States Patent [19]

Brännström et al.

[11] Patent Number: 4,848,276

[45] Date of Patent: Jul. 18, 1989

[54] FLUIDIZED BED POWER PLANT WITH BED MATERIAL CRUSHER

[75] Inventors: Roine Brännström, Finspong; Evert Lindblad, Norrköping; Leopold Malmkvist, Ljusfallshammar; Martin Mansson, Finspong; Mats Thorén, Norrköping, all of Sweden

[73] Assignee: Asea Stal AB, Sweden

[21] Appl. No.: 157,661

[22] Filed: Feb. 19, 1988

[30] Foreign Application Priority Data

Feb. 19, 1987 [SE] Sweden ..... 8700680

[51] Int. Cl.[4] ..... F23G 5/00; F22B 1/00

[52] U.S. Cl. ..... 122/4 D; 110/263; 110/245; 241/257 R

[58] Field of Search ..... 110/245, 263, 266, 255, 110/259, 346, 347, 165 R; 122/4 D; 60/39, 464; 431/7, 170; 414/209, 210, 214, 216; 241/237, 238, 239, 241, 250, 257 R

[56] References Cited

U.S. PATENT DOCUMENTS

| | | | |
|---|---|---|---|
| 1,393,632 | 10/1921 | Mitchell | 241/257 R |
| 2,478,937 | 8/1949 | Niethemer | 241/257 R |
| 2,937,815 | 5/1960 | Girich et al. | 241/257 R |
| 4,421,036 | 12/1983 | Brannstrom et al. | 110/263 X |
| 4,610,397 | 9/1986 | Fischer et al. | 241/257 R X |
| 4,669,395 | 6/1987 | Brannstrom | 110/263 X |

FOREIGN PATENT DOCUMENTS

| | | | |
|---|---|---|---|
| 0108505 | 5/1984 | European Pat. Off. . | |
| 0167992 | 1/1986 | European Pat. Off. . | |
| 84/04955 | 12/1984 | PCT Int'l Appl. . | |
| 0755298 | 8/1980 | U.S.S.R. | 241/257 R |

*Primary Examiner*—Henry C. Yuen

[57] ABSTRACT

A power plant utilizing combustion of fuel in a fluidized bed contains a particulate sulfur-absorbing material. A discharge device for bed material and ashes includes a crusher which breaks down the material so that it can be transported away or so that unconsumed absorbent in the bed material is exposed for reuse in the bed. The crusher has a stationary grinding portion and a rotating grinding portion receiving bed material. Scrapers selectively scrape off layers of material during rotation of the rotating grinding portion thus distributing the material around the periphery of the grinding portions.

12 Claims, 3 Drawing Sheets

A - A

SIGNAL PROCESSING UNIT
CONTROL UNIT
CONTROL UNIT
G
ΔP2
ΔP1

A - A

FLUIDIZED BED POWER PLANT WITH BED MATERIAL CRUSHER

TECHNICAL FIELD

The invention relates to a power plant, primarily a Pressurized Fluidized Bed Combustion (PFBC) power plant, involving combustion of a sulfur-containing fuel in a fluidized bed containing a particulate sulfur-absorbing material in a bed vessel. A discharge device for bed material and ashes includes a crusher having a controlled capacity. The crusher breaks down slag lumps so that the bed material can be transported away via a pressure reducing pneumatic transport device, or grinds down bed material so that unconsumed absorbent in the bed material is exposed and, after having been fed back into the bed, is utilized.

BACKGROUND ART

Absorbent must be permanently supplied to the bed in dependence on the sulfur contents in the fuel. Bed material and ashes formed from the fuel or slag particles which do not accompany the combustion gases must be continuously or intermittently removed to prevent the bed level from rising. Fine-grained material, such as finer fractions of ashes and particles abraded off lumps of bed material, accompany the combustion gases, and are separated in a cleaning plant and transported away therefrom. Bed material, ashes and slag have to be removed by being tapped off from the bed vessel through a controllable discharge device.

Brannstrom et al U.S. patent application Ser. No. 917649 (filed Oct. 10th, 1986) describes a power plant with a fluidized bed, in which the bed level is controlled by grinding down bed material and directly returning the ground down bed material to the bed. The grinding takes place to such a small particle size that the ground bed material leaves the bed vessel together with the combustion gases, is separated in a cleaning plant and is removed, suitably through a pneumatic pressure reducing discharge device for example of the kind described in European Pat. No. 0 108 505 Swedish patent application No. 8602486-6 describes a PFBC power plant with a discharge device for bed material with a slag crusher in which slag lumps above a certain size are crushed in such a dimension that they can be transported to a collecting container through a pneumatic pressure reducing transport device.

SUMMARY OF THE INVENTION

According to the invention, the discharge device of the plant includes a crusher with a vertical shaft located below the bed vessel. This crusher is supplied with bed material from the bed vessel via a tube extending from the bed vessel. The crusher comprises a housing with a ring forming the stationary crushing or grinding portion of the crusher. A vertical shaft journalled in the housing supports a conical, circular body, forming the rotating grinding portion of the crusher, and a substantially horizontal disk. The plate and the grinding portion may be constructed as one unit and formed as a truncated cone. The upper surface of the truncated cone forms the disk. A supply tube for bed material in the upper part of the housing is connected to the outlet tube and opens out above the plate, eccentrically in relation to the axis of rotation of the crusher. In the housing, above the plate supported by the shaft, there are a number of stationary scrapers which distribute the bed material coming in through the outlet tube such that bed material falling down between the grinding portions of the crusher is evenly distributed along the periphery of the plate. This results in uniform wear around the stationary grinding portion.

The scrapers can be designed and arranged in different ways. They are suitably located at different levels above the plate and have an orientation which deviates from the radial direction, suitably arcuate or helical as the blades of the impeller of a centrifugal pump. Desirably the gap between the plate and each scraper is decreased in the direction of rotation, each one of the scrapers thus removing a material layer when the disk is rotating. This results in a substantially even distribution of material along the periphery and in uniform wear in the crusher. It would also be possible to use scrapers at the same level but having different lengths in the radial direction.

BRIEF DESCRIPTION OF THE DRAWINGS

The invention will now be described in greater detail, by way of example, with reference to the accompanying drawings, wherein.

DESCRIPTION OF PREFERRED EMBODIMENT

Figure 1:
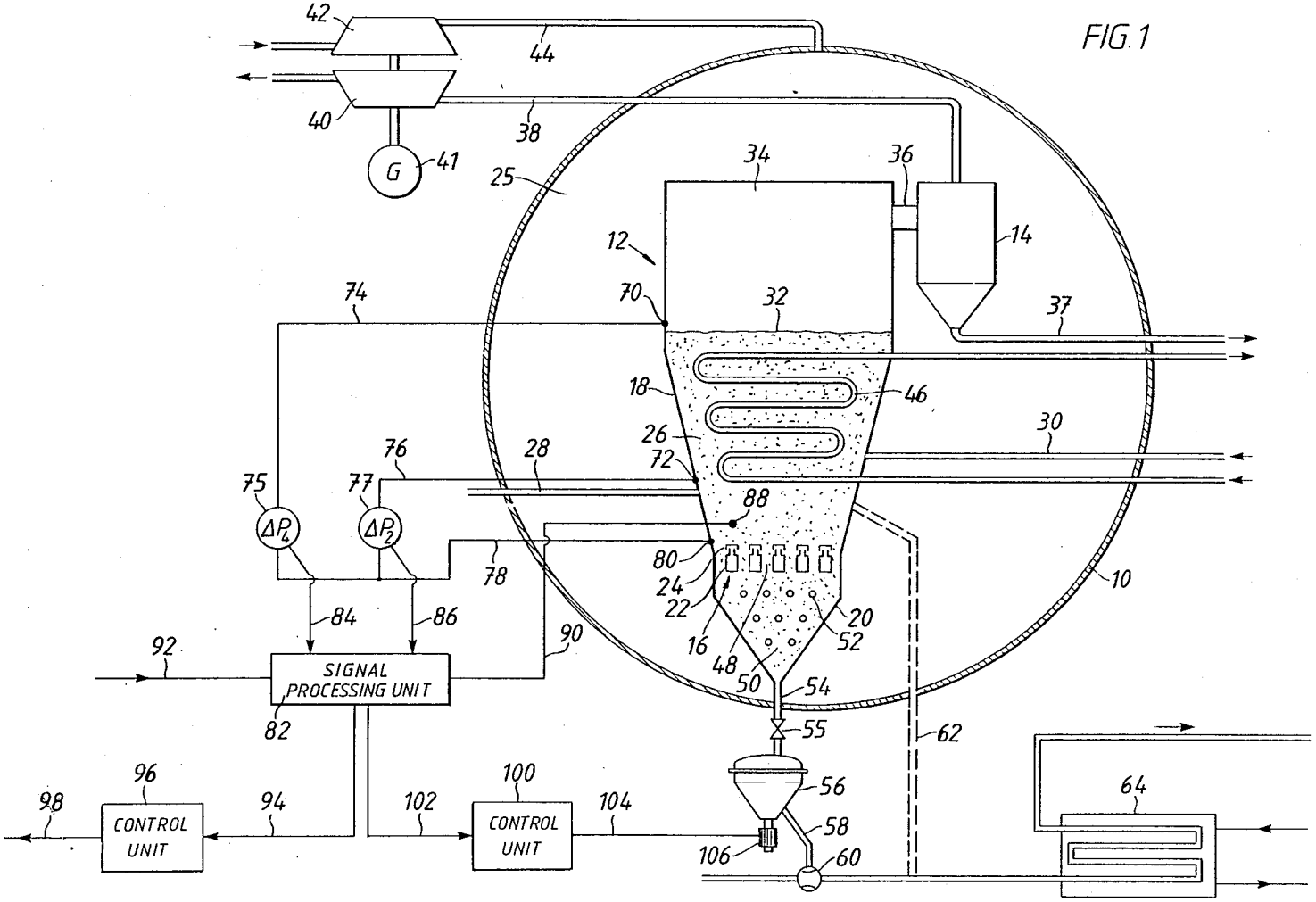
FIG. 1 schematically shows a PFBC power plant incorporating the invention.

In FIG. 1, 10 designates a pressure vessel. In it are arranged a bed vessel 12 and a gas cleaning plant symbolized by a cyclone 14. In reality the cleaning plant may consist of parallel-connected groups of series-connected cyclones. The lower part of the bed vessel 12 includes an air distributor 16, which divides the bed vessel 12 into an upper combustion chamber 18 and a lower ash chamber 20. The air distributor 16 consists of a number of elongated air distribution chambers 22 with air nozzles 24. The chambers 22 communicate with a space 25 between the pressure vessel 10 and the bed vessel 12. This space 25 contains combustion air under pressure. Through the nozzles 24 the combustion chamber 18 is supplied with air for fluidizing a bed 26 of particulate material containing a sulfur absorbent and for combustion of a fuel which is supplied to the bed 26 from a fuel storage (not shown) through a fuel pipe 28. Fresh bed material is supplied to the bed 26 from a reservoir of bed material (not shown) via a pipe 30. Above the upper surface 32 of the bed there is a freeboard 34 for collecting the combustion gases. From the freeboard 34 the combustion gases are passed, via a pipe 36, to the cleaning plant 14 and the cleaned gases are led, via a pipe 38, to a turbine 40. The turbine 40 drives a generator 41 and a compressor 42. Combustion air compressed in the compressor 42 is supplied to the space 25 through a pipe 44. Dust separated in the cleaning plant 14 is transported away to a collecting container (not shown) through a pipe 37. The bed 26 contains tubes 46 for generating steam for driving a steam turbine (not shown) and for cooling the bed 26.

Between the elongated air distribution chambers 22 there are openings 48, through which bed material from the bed 26 may pass down to the ash chamber 20. The material 50 in the ash chamber 20 consists of ashes, slag and consumed and unconsumed sulfur absorbent. The ash chamber 20 includes tubes 52 for cooling the material 50. The coolant in these tubes 52 may, for example, consist of combustion air, steam or water. The material 50 is removed from the ash chamber 20 through an outlet tube 54 and a crusher 56. The tube 54 may include a valve 55. The crusher 56 has an outlet 58.

In one embodiment of the present invention, the crusher 56 may be constructed in such a way that it only crushes slag lumps to a grain size of about 7–10 mm, whereas all other material having a grain size of about 3–6 mm may pass freely without being reduced in size. In this case slag is broken down so that the material fed out through the crusher 56 is given an appropriate maximum grain size for example that which is required for pneumatic transportation. The pressure in the crusher 56 should, in a PFBC power plant, be approximately equal to the pressure in the bed vessel 12. The outlet 58 of the crusher 56 is connected, either directly or through an ejector 60, to a pressure-reducing discharge device 64 having a plurality of series-connected tube parts with sharp bends between adjacent tube parts, such as for example, a device described in EP No. 0108505. This ejector 60 may be fed with propellant gas directly from the space 25 or through a booster compressor, which on its suction side is connected to the space 25 in the pressure vessel 10. In another embodiment of the invention, the crusher 56 may be designed in such a way that it crushes both slag lumps and other fed-out bed material. Unconsumed sulfur absorbent in the interior of bed material particles is then exposed, and the crushed material is returned to the bed 26. The outlet 58 of the crusher 56 is then connected to the combustion chamber 18 through the ejector 60 and the dash-lined return pipe 62.

For measuring the depth of the bed 26, differential pressure sensors 75, 77 are provided, which are connected on one side through pipes 74, 76 to the bed vessel 12 at different heights at points 70, 72 and which are connected on their other side, through a common pipe 78, to the bed vessel 12 at a point 80 approximately on a level with the air distributor 16. In reality more than two differential pressure sensor would normally be provided. These pressure sensors 70, 72 are connected to a signal processing unit 82 through pipes 84, 86. A temperature sensor 88 in the bed 26 is also connected, through a line 90, to the signal processing unit 82. A desired value, determined by the power level, is supplied to the signal processing unit 82 from a power control equipment (not shown) through a line 92. A control unit 96 for a supply device (not shown) for fresh bed material is connected to the signal processing unit 82 by a line 94 and to the supply device by a line 98. A control unit 100 is connected to the signal processing unit 82 by a line 102 and to a drive motor 106 of the crusher 56 by a line 104. At constant power output, the feeding out of material 50 from the ash chamber 20 is controlled by controlling the speed of the motor 106 and hence of the crusher 56, so that the upper surface 32 of the bed is maintained at a constant level. The amount of removed bed material is equal to the amount of supplied bed material and fuel residue, such as coal ashes formed which does not accompany the combustion gases out from the freeboard 34. When the power is reduced, the level of the upper surface 32 is lowered by increasing the speed of the crusher 56, and when the power is increased, the level of the surface 32 is raised by stopping the crusher of reducing its speed and increasing the rate of supply of fresh bed material.

Figure 2:
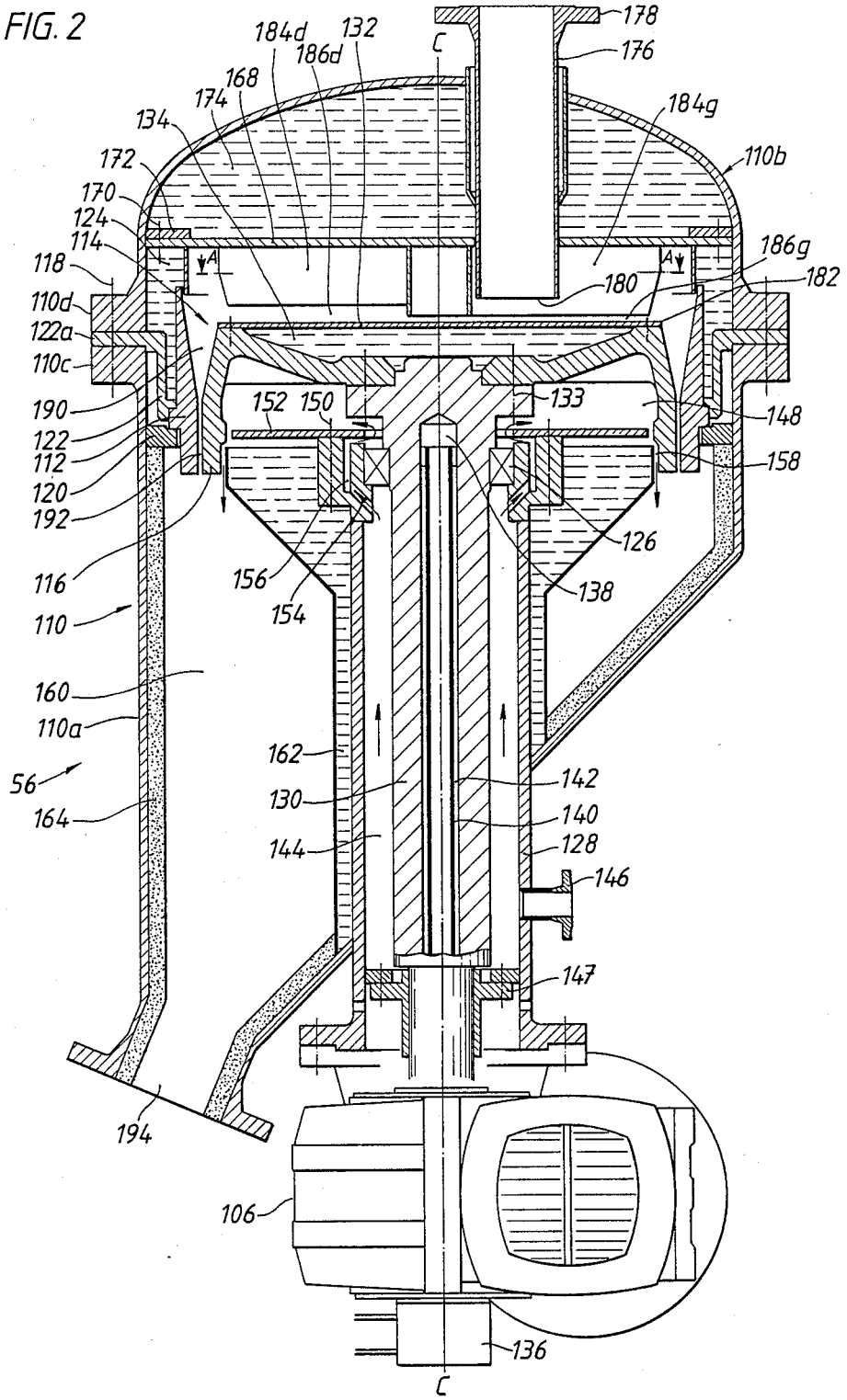
FIG. 2 shows, in sectional elevation, the crusher included in the plant of FIG. 1.

FIG. 2 shows, on an enlarged scale, a section of the vertical crusher 56 included in the plant of FIG. 1. The crusher 56 comprises a housing 110 with a stationary grinding portion 112 and a rotor 114 with a rotating grinding portion 116. The housing 110 consists of a lower part **110*a* and an upper part 110*b*, which parts are formed with flanges 110*c* and 110*d*, respectively, and are joined together by means of a bolted joint 118. Despite cooling in the ash chamber 20, the material 50 has a relatively high temperature, up to 400° C., when leaving the ash chamber 20. The parts of the crusher 56 are thus subjected to a high temperature, which must be taken into account during the design work. The stationary grinding portion 112 is constructed as a replaceable ring resting on a flange 120 in the lower part 110*a* of the housing 110 in such a way that it may expand radially. The stationary grinding portion 112 is retained by a resilient centering ring 122 with a flange 122*a* which is clamped between the flanges 110*c* and 110*d*. The space between the stationary grinding portion 112 and the housing 110 is filled with heat insulating material 124**.

The rotor 114 of the crusher 56 is journalled in an upper bearing 126 in a sleeve 128 which slides into the lower part **110*a* of the crusher housing 110, and in a lower bearing in the drive motor 106. The upper bearing 126 is suitably positioned on a level with the lower edge of the stationary grinding portion 112. The rotor 114 comprises a shaft 130 which is connected at its bottom end to the output shaft of the motor 106. At its upper end the shaft 130 supports a suitably annular rotating grinding portion 116 and a suitably plane plate 132 connected to the grinding portion 116. The grinding portion 116, the shaft 130 and the plate 132 jointly define a volume which is filled with a heat-insulating material 134. The shaft 130 and the grinding portion 116 are joined together by a bolted joint 133. The shaft 130 is internally water-cooled, cooling water being introduced and discharged through a rotating connection 136. The shaft 130 is provided with a bore 138. The cooling water is introduced into a central tube 140 in the bore 138 so as to obtain satisfactory cooling of the upper part of the shaft 130 and of the bearing 126. The cooling water is returned through a gap 142 between the wall of the bore 138 and the tube 140. Between the shaft 130 and the sleeve 128 there is formed an annular gap 144. At the lower part of the sleeve 128 there is a sealing device 147 between the sleeve 128 and the shaft 130. Through the connection 146 the gap 144 is supplied with air or other gas, partly for cooling the sleeve 128 and partly for cleaning the space 148 between the rotating grinding portion 116 and a disk 152 which is joined to the sleeve 128 by a bolted joint 150. As shown by the arrows the gas flows up through the gap 144, through openings 154, an annular gap 156, a space 148 and an annular gap 158 to a collecting space 160 for the crushed material. The sleeve 128 is externally provided with heat insulation 162. The lower part 110*a* of the housing 110 is internally provided with a layer of abrasion-resistant, heat insulating material 164**.

The upper part **110*b* of the crusher housing 110 is internally provided with a disk 168 which is joined by means of a bolted joint 170 to an annular flange 172. Thermal insulating material 174 is provided in the space above the disk 168. Through the upper part 110*a* of the crusher housing 110 there passes an inlet tube 176. The inlet tube 176 is joined to a flange on the outlet tube 54** by means of a flange 178 and a bolted joint. The inlet tube 176 is located eccentrically in relation to the vertical axis C—C of the crusher 56. The inlet tube 176 opens out in an orifice 180 at such a height above the plate 132 of the rotor 114 that the largest slag lumps, 40–60 mm, that may pass the gap 48 or rectangular openings between the chambers 22 of the air distributors, are able to pass between the orifice 180 and the plate 132. The distance from the edge 182 of the plate 132 is so large that bed material falling down through the tube 176 does not of its own run over the edge 182 of the plate 132.

The disk 168 is provided on its lower side with a number of scrapers **184*a*–184*g* which have an orientation deviating from the radial. The scrapers 184*a*–184*g* are suitably shaped to trace arcuate lines over the surface of the plate 132, as shown in FIG. 3, and have different vertical extensions so that between them and the plate 132 there are formed gaps 186*a*–186*g*** with a successively diminishing size.

Figure 3:
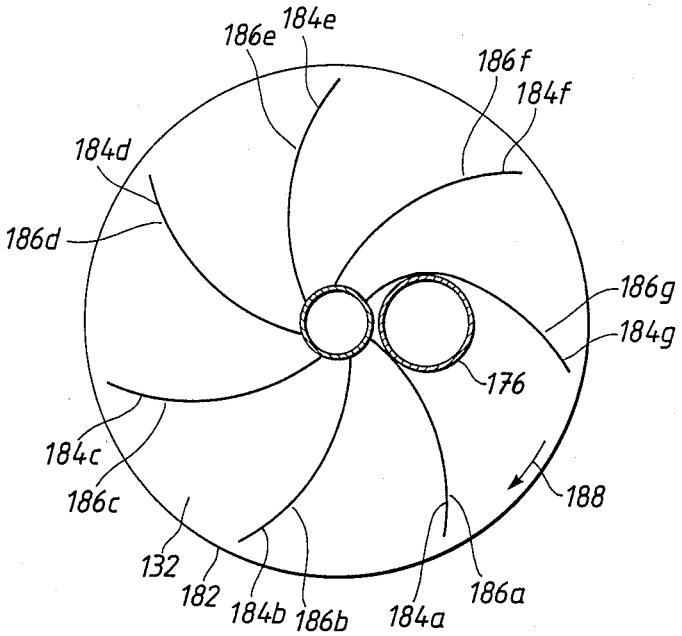
FIG. 3 shows a cross sectional view taken along line A—A in FIG. 2 indicating the disposition of the scrapers in the crusher.

When the rotor 114 rotates, as indicated by the arrow 188 in FIG. 3, material on the plate 132 will be scraped off by an appropriate one of the scrapers **184*a*–184*g*. The first scraper 184*a* scrapes off a first material layer, the second scraper 184*b* scrapes off a second material layer, and so on, because of the fact that the gaps 186*a*–*g* between the scrapers 184*a*–184*g* successively decrease in size. In this way the material is distributed relatively evenly along the periphery 182 of the plate 132 to the conical gap 190 between the two grinding portions 112 and 116 of the crusher 56. In the conical gap 190 the slag lumps are crushed. In those cases where the crusher 56 is employed only to ensure that larger pieces of material are crushed to such a size, suitably 7–10 mm, that they may pass freely through a pressure-reducing pneumatic discharge device, the gap 192 between the grinding portions 112 and 116 has such a size that the main part of the bed material having a size of about 3–6 mm is able to fall freely through the gap 192 into the space 160 without reduction in size and thus without giving rise to wear of the grinding portions. The outlet 194 is connected to the outlet pipe 58. In those cases where the crusher 56 is also used for crushing bed material particles so that absorbent which has not been utilized in inner parts of the particles is exposed, the gap 192** has such a size as to obtain a fine-grained material with a large effective absorption surface of the yet-to-be-utilized absorbent.

It will be appreciated that the form of crusher described with reference to FIGS. 2 and 3 is open to wide variations and all such variations with the scope of the following claims are intended to be within the scope of the invention.

What is claimed is:

1. In a power plant for the combustion of a fuel in a fluidized bed including a bed vessel, a bed material within the bed vessel, supply means for adding sulfur-absorbing material and fuel to the bed material, means for supplying the bed vessel with a compressed air for fluidization of the bed material and for combustion of the fuel supplied to the bed and a discharge means with controllable discharge capacity for removal of the bed material from the bed vessel through an outlet means extending from the bed vessel, said discharge means including:

a housing;

a vertical shaft journalled in said housing;

a driving motor for rotating said shaft;

means for controlling the speed of said driving motor;

a substantially horizontal plate supported by said shaft;

a connecting means in communication with said outlet tube of the bed vessel for supplying the bed material to be discharged, to a space above said plate, said connecting means being positioned above said plate and eccentrically with respect to the axis of rotation of said shaft;

a plurality of stationary scrapers arranged in said housing above said plate, said scrapers upon rotation of said plate distributing material radially over the edge of said plate; and crushing means located in said housing and including an annular rotating crushing member supported by said shaft below the peripheral edge of said plate and a stationary crushing member surrounding said rotating crushing member and horizontally spaced therefrom, said crushing means reducing the size of slag lumps in the bed material which are in excess of the size of a gap formed between said rotating and stationary crushing members.

2. A power plant according to claim 1, in which said scrapers are arranged at different heights above said plate.

3. A power plant according to claim 1, in which said scrapers have different vertical extensions in the radial direction of said plate.

4. A power plant according to claim 2, in which said scrapers have different vertical extensions in the radial direction of said plate.

5. A power plant according to claim 3, wherein said scrapers trace arcuate lines over the surface of said plate.

6. In a power plant for the combustion of a fuel in a fluidized bed including a bed vessel, a bed material within the bed vessel, supply means for adding sulfur-absorbing material and fuel to the bed material, means for supplying the bed vessel with a compressed air for fluidization of the bed material and for combustion of the fuel supplied to the bed and a discharge means with controllable discharge capacity for removal of the bed material from the bed vessel through an outlet means extending from the bed vessel, said discharge means including:

a housing;

a vertical shaft journalled in said housing;

a driving motor for rotating said shaft;

means for controlling the speed of said driving motor;

a substantially horizontal plate supported by said shaft;

a connecting means in communication with said outlet tube of the bed vessel for supplying the bed material to be discharged, to a space above said plate, said connecting means being positioned above said plate and eccentrically with respect to the axis of rotation of said shaft;

a plurality of stationary scrapers arranged in said housing above said plate, said scrapers having different extensions in the radial direction of said plate, said scrapers upon rotation of said plate distributing material radially over the edge of said plate; and crushing means located in said housing and including an annular rotating crushing member supported by said shaft below the peripheral edge of said plate and a stationary crushing member surrounding said rotating crushing member and horizontally spaced therefrom, said crushing means reducing the size of slag lumps in the bed material which are in excess of the size of a gap formed between said rotating and stationary crushing members.

7. A power plant according to claim 6, in which said scrapers trace arcuate lines over the surface of said plate.

8. A power plant according to claim 6, in which said scrapers trace arcuate lines over the surface of said plate.

9. A power plant according to claim 6, wherein an outlet of said crushing means is connected to said bed vessel by a pipe for returning crushed bed material to said bed vessel.

10. A power plant according to claim 6, wherein the combustion in said bed vessel takes place at a pressure considerably exceeding atmospheric pressure and wherein said crushing means is connected, on its outlet side, to a pneumatic pressure-reducing transport device, in which pressure reduction is brought about by passing the material flow along a plurality of series-connected tube parts with sharp bends between adjacent tube parts.

11. A power plant according to claim 6 wherein said bed vessel is enclosed in a pressure vessel with a space between the pressure vessel and the bed vessel for compressed combustion air, from which space the bed vessel is supplied with air for fluidization of the bed and combustion of the fuel, and wherein said crushing means is connected on its outlet side to a pneumatic, pressure-reducing transport device, in which pressure reduction is brought about by passing the material flow along a plurality of series-connected tube parts with sharp bends between adjacent tube parts.

12. A power plant according to claim 6, wherein the bed vessel is enclosed within a pressure vessel with a space between the pressure vessel and the bed vessel for compressed combustion air, from which the bed vessel is supplied with air for fluidization of the bed and combustion of the fuel, and wherein said crushing means is connected on its outlet side to said bed vessel by means of a pneumatic conveying pipe for returning the crushed bed material to said bed.

* * * * *